US008908896B2

(12) United States Patent
Betts

(10) Patent No.: US 8,908,896 B2
(45) Date of Patent: Dec. 9, 2014

(54) EARPIECE FOR AN ELECTRONIC DEVICE

(75) Inventor: Ian Betts, Newmarket on Fergus (IE)

(73) Assignee: Intel Corporation, Santa Clara, CA (US)

( * ) Notice: Subject to any disclaimer, the term of this patent is extended or adjusted under 35 U.S.C. 154(b) by 1 day.

(21) Appl. No.: 13/538,299

(22) Filed: Jun. 29, 2012

(65) Prior Publication Data

US 2014/0003642 A1 Jan. 2, 2014

(51) Int. Cl.
*H04R 25/00* (2006.01)

(52) U.S. Cl.
USPC ..... 381/328; 381/380

(58) Field of Classification Search
CPC .... H04R 25/652; H04R 25/456; H04R 25/65; H04R 1/1016; H04R 1/1058
USPC ..... 381/328, 380
See application file for complete search history.

(56) References Cited

U.S. PATENT DOCUMENTS 3,110,356 A * 11/1963 Mendelson ..... 181/130
3,602,654 A 8/1971 Victoreen
3,954,357 A * 5/1976 Ziehl ..... 418/137
4,133,984 A * 1/1979 Akiyama ..... 381/328
4,651,897 A * 3/1987 Johnson ..... 222/55
4,834,211 A * 5/1989 Bibby et al. ..... 181/135
4,995,173 A * 2/1991 Spier ..... 36/29
5,074,765 A * 12/1991 Pekar ..... 417/480
5,375,345 A * 12/1994 Djuric ..... 36/3 B
5,405,060 A * 4/1995 von Schuckmann ..... 222/325
5,421,454 A * 6/1995 Chern ..... 206/315.6
6,085,444 A * 7/2000 Cho ..... 36/3 B
6,370,800 B1 * 4/2002 Hung ..... 36/3 B
6,648,471 B1 * 11/2003 Dalrymple et al. ..... 351/111
6,767,337 B1 * 7/2004 Ewerlof ..... 604/153
7,093,609 B2 * 8/2006 Chen ..... 137/231
7,278,445 B2 * 10/2007 Marvin et al. ..... 137/601.2
7,425,196 B2 * 9/2008 Jorgensen et al. ..... 600/25
7,639,831 B2 * 12/2009 Hagberg ..... 381/380
2006/0147079 A1 * 7/2006 Jaakkola ..... 381/380
2007/0053543 A1 * 3/2007 Lee ..... 381/381
2007/0240721 A1 * 10/2007 Ho et al. ..... 128/207.13
2009/0028356 A1 * 1/2009 Ambrose et al. ..... 381/71.6
2009/0071486 A1 * 3/2009 Perez et al. ..... 128/858
2009/0173353 A1 * 7/2009 Purcell et al. ..... 128/865
2009/0197650 A1 * 8/2009 Kulas ..... 455/569.1
2010/0322454 A1 * 12/2010 Ambrose et al. ..... 381/380
2011/0196304 A1 * 8/2011 Kramer et al. ..... 604/151
2011/0209879 A1 * 9/2011 Quigley et al. ..... 166/369
2012/0012333 A1 * 1/2012 Quigley et al. ..... 166/369
2013/0136285 A1 * 5/2013 Naumann ..... 381/329
2014/0037122 A1 * 2/2014 Lee ..... 381/380

* cited by examiner

*Primary Examiner* — Matthew Eason
*Assistant Examiner* — Sean H Nguyen
(74) *Attorney, Agent, or Firm* — Ked & Associates

(57) ABSTRACT

A docking earpiece may be provided. The docking ear piece may include a body, an earpiece plug on the body, and a first bladder in the earpiece plug. The earpiece plug may be provided in a first state and a second state. The earpiece plug may control the earpiece plug to be in the first state and to control the earpiece plug to be in a second state.

27 Claims, 2 Drawing Sheets

EARPIECE FOR AN ELECTRONIC DEVICE

BACKGROUND

1. Field

Embodiments may relate to an earpiece for an electronic device.

2. Background

As mobile computing continues, device functions are being consolidated, and mobile devices may be getting smaller and slimmer. There are practical physical and essentially human factors that constrain the form and function, and ultimately usability of mobile devices (or electronic devices).

The integration of mobile devices (i.e., telephone) with mobile computing functions may present a challenge. Mobile internet devices, laptops, netbooks, tablets, mobile terminals and so on, may be capable of hosting voice telecommunications. These devices may require the user to connect an external headset or other similar equipment.

The user may have to carry around his/her headset or earpieces as well as the mobile device. The headsets and/or earpieces may be fragile and may have limited service life. The headsets and/or earpieces may be easily lost or damaged. Still further, the headsets and/or earpieces may often need to be charged.

BRIEF DESCRIPTION OF THE DRAWINGS

Embodiments and/or arrangements may be described in detail with reference to the following drawings in which like reference numerals refer to like elements and wherein.

DETAILED DESCRIPTION

Figure 1:
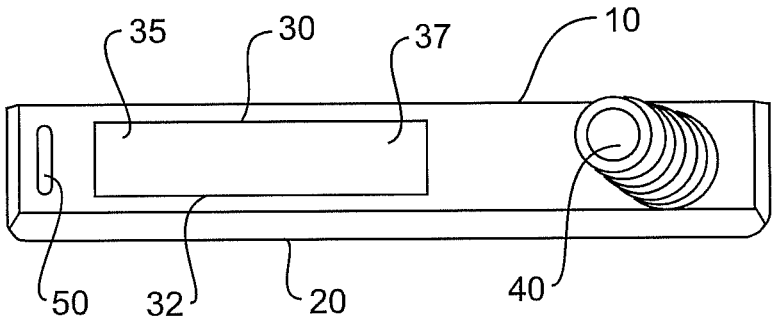
FIG. 1 is a view of a docking earpiece according to an example embodiment.

FIG. 1 is a view of a docking earpiece according to an example embodiment. Other embodiments and configurations may also be provided.

FIG. 1 shows a docking earpiece 10 that includes a body 20, part of a pump device 30, an earpiece plug 40 and a microphone 50. The pump device 30, the earpiece plug 40 and the microphone 50 may all be provided on or in the body 20 of the docking earpiece 10. The earpiece plug 40 may also be referred to as an expandable earpiece plug.

FIG. 1 also shows that the pump device 30 includes a pivoting button 32 that may pivot about an axis. The pivoting button 32 may include a first top side 35 and a second top side 37. A user may press the first top side 35 of the pivoting button 32 to pump air into the earpiece plug 40. On the other hand, a user may press the second top side 37 to release air (and pressure) from the earpiece plug 40. Gases other than air may also be used.

The earpiece plug 40 may be formed of a plurality of concentric folds each with a different width. When the earpiece plug 40 is expanded, the plurality of concentric folds may have a conical form or shape. This may be considered a first state of the earpiece plug 40. When the earpiece plug 40 is collapsed, larger ones of the plurality of concentric folds may surround smaller ones of the concentric folds. This may be considered a second state of the earpiece plug 40.

A user may provide the earpiece plug 40 near his/her ear so that audio signals may be heard through the earpiece plug 40. A height of the earpiece plug 40 (from the body 20) may be controlled so that the user may provide the earpiece plug 40 to have desired diameter at a top of the conical structure of the earpiece plug. The desired diameter may depend on various factors such as size of one's ear.

Figure 2:
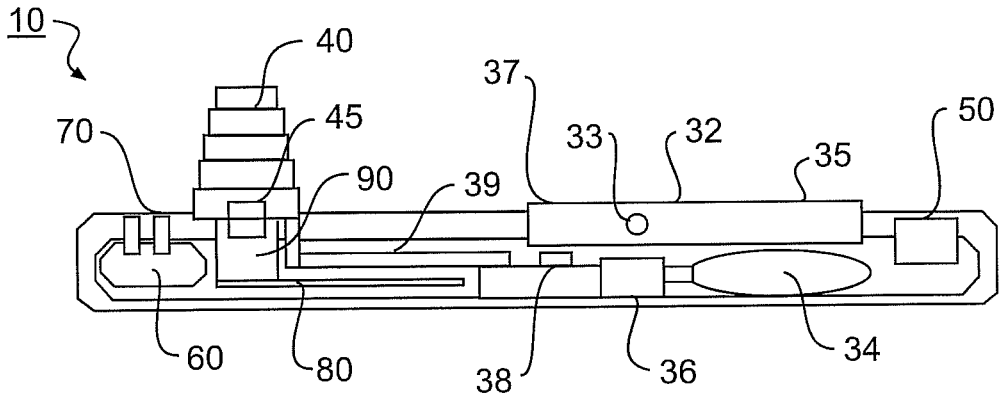
FIG. 2 is a side view of a docking earpiece according to an example embodiment.

FIG. 2 is a side view of a docking earpiece according to an example embodiment. Other embodiments and configurations may also be provided.

FIG. 2 shows a side view of the docking earpiece 10. The side view shows various components of the pump device 30 including the pivoting button 32, a bladder 34, a non-return valve 36 (or non-return device), a pressure release valve 38 (or pressure release device) and an air duct 39.

The pivoting button 32 may pivot about an axis 33 based on a user pressing either top surface of the pivoting button 32. For example, if the first top side 35 of the pivoting button 32 is pressed downward, then the bladder 34 may depress (or collapse) so that air within the bladder 34 may be provided (or pumped) toward the earpiece plug 40. On the other hand, if the second top side 37 of the pivoting button 32 is pressed downward, then the pressure release valve 38 may be opened and air (and pressure) may be released from the earpiece plug 40.

The bladder 34 may be provided in the earpiece plug 40 or under the earpiece plug 40 to control the earpiece plug 40 to be in the first state and to control the earpiece plug 40 to be in the second state.

As shown in FIG. 2, the bladder 34 may be coupled to the non-release value 36. The non-release valve 36 may operate so that air only passes in one direction, namely from the bladder 34 and toward the air duct 39 and the earpiece plug 40. The non-release valve 36 may substantially prevent (or stop) the flow of air from the air duct 39 to the bladder 34.

As shown in FIG. 2, the pressure release valve 38 may also be coupled to the air duct 39. When the second top side 37 of the pivoting button 32 presses down on the pressure release valve 38, the pressure release valve 38 may release air (and/or pressure) from the air duct 39 and the earpiece plug 40.

FIG. 2 also shows other components that are provided with the body 20 and/or on the body 20. These components include a battery 60 to store a charge, electrical connectors 70 (or an electrical connector), an electric circuit 80 and an earpiece transducer 90. The electrical connectors 70 may make an electrical connection to a main body of a mobile device (or an electronic device) when the earpiece 10 is mounted to the main body of the mobile device. This may allow an electric charge (or power) from the main body to electrically charge the battery 60 while the body 20 is mounted to the main body.

The electric circuit 80 may include a wireless receiver and audio circuits. The wireless receiver may receive wireless signals from a wireless communication device on the main body. The wireless receiver may receive the wireless signals and then the earpiece transducer 90 (on the earpiece 10) may convert the wireless signals from the wireless receiver into audio signals that may be heard via the earpiece plug 40.

The earpiece plug 40 may be an expandable earpiece plug that expands to a first state and that collapses to a second state. The first state of the earpiece plug 40 may be an expanded state of the earpiece plug 40 such as shown in FIG. 2. The second state of the earpiece plug 40 may be a collapsed state of the earpiece plug 40. The earpiece plug 40 may also expand to any location (or position) between the fully expanded state and the fully collapsed state. The pump device 30 may expand the expandable earpiece plug and/or connect the expandable earpiece plug.

The pump device 30 (discussed above) may expand the bladder 34 such that the earpiece plug 40 is in the first state, and the pump device 30 may contract the bladder such that the earpiece plug 40 is in the second state.

FIG. 2 also shows that a bladder 45 (or expand device) may be provided at or near the earpiece plug 40. The bladder 45 may be considered as part of the expandable earpiece plug. The bladder 45 may operate to receive air from the air duct 39 and thereby expand. The expansion of the bladder 45 may cause the earpiece plug 40 to expand. The expansion of the bladder 45 may be to any position up until the earpiece plug 40 reaches the fully expanded state. The expansion of the bladder 45 may cause the concentric folds to push upward and form a conical shape.

Upon opening of the pressure release valve 38, air (or gas) may exit from the bladder 45 and the air duct 39, and the air (or gas) may be provided to outside of the earpiece 10. Stated differently, the bladder 45 may collapse or deflate upon the opening of the pressure release valve 38. The collapse or deflation of the bladder 45 may cause the earpiece plug 40 to collapse (i.e., the concentric folds may collapse down to a flat state). The collapsing of the earpiece plug 40 may be to any position until the earpiece plug 40 reaches the fully deflated (or collapsed) state.

Figure 3:
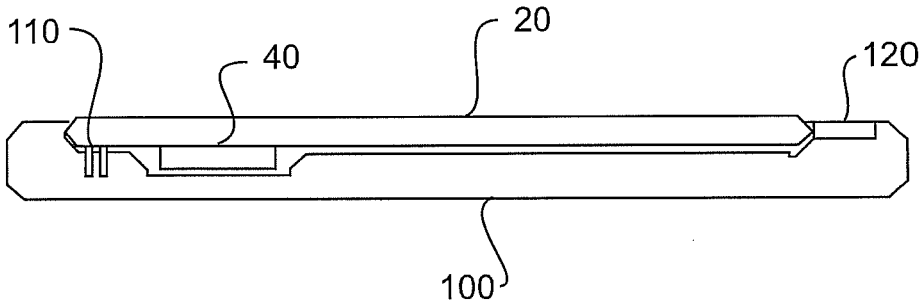
FIG. 3 is an end view of a docking earpiece and a mobile device according to an example embodiment.

FIG. 3 is an end view of a docking earpiece and a mobile device (or electronic device) according to an example embodiment. Other embodiments and configurations may also be provided.

FIG. 3 shows the earpiece 10 mounted to a main body 100 of the mobile device (or electronic device). The mobile device (or electronic device) may collectively include the main body 100 and the earpiece 10. The main body 100 may include many components 100, such as electrical connectors 110 that may electrically connect with electrical connectors 70 of the earpiece 10 such that the battery 60 may be charged. The charging may be directly from an AC power source or from a DC power source such as a battery within the main body 100 of the mobile device.

The main body 100 may also include a retaining device 120 (or retaining latch) to hold the earpiece 20 to the main body 100 of the mobile device.

FIG. 3 also shows the earpiece plug 40 in a collapsed state (or second state). The collapsed state of the earpiece plug 40 may be obtained by the pressing and/or opening of the pressure release valve 38, which may be based on a user pressing the second top side 37 of the pivoting button 32. This may allow the earpiece 10 to properly fit on the main body 100 of the mobile device.

Figure 4:
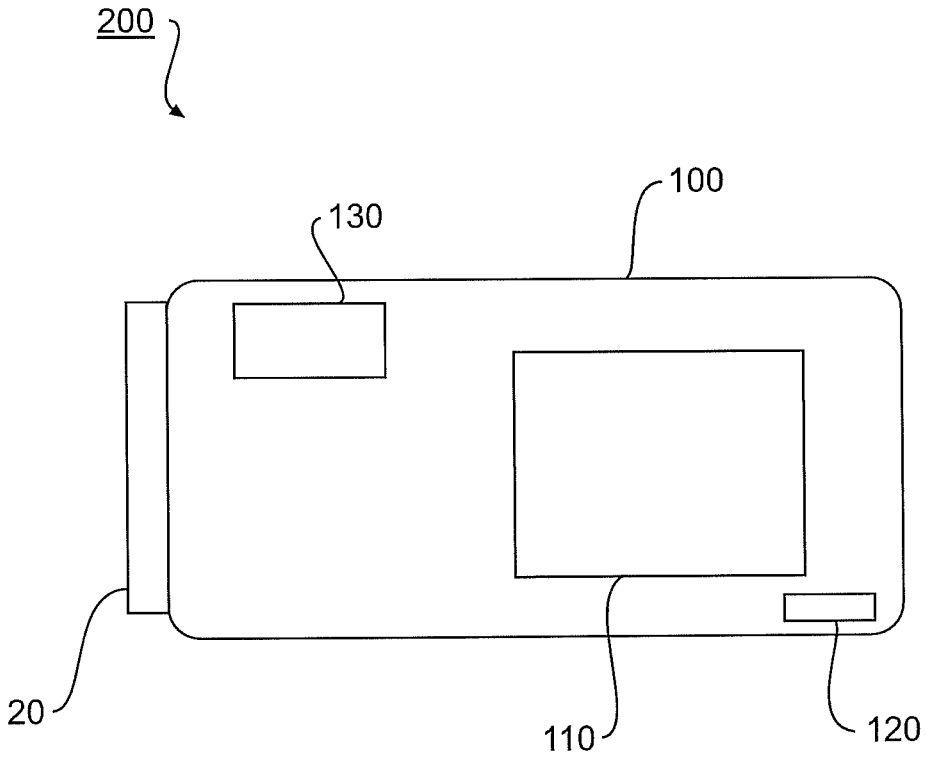
FIG. 4 is a top view of a docking earpiece and a mobile device according to an example embodiment.

FIG. 4 is a top view of a docking earpiece and a mobile device (or electronic device) according to an example embodiment. Other embodiments and configurations may also be provided.

FIG. 4 shows that the mobile device 200 includes the main body 100 and the docking earpiece 10. As shown in FIG. 4, the body 20 of the earpiece 10 may be mounted on a bottom end of the main body 100. Alternatively, the body 20 of the earpiece 10 may be mounted on a top end of the main body 100. The earpiece 10 may be mounted such that the electrical connectors 70 of the earpiece 10 are electrically connected to the electrical connectors 110 of the main body 100.

The main body 100 may include a display device 110, an antenna 120 and a wireless communication device 130. The display device 110 may display images. The antenna 120 may transmit and receive wireless signals to a wireless network. These signals may be received by other wireless devices, such as another mobile device.

The wireless communication device 130 may provide wireless communication with the earpiece 10. This type of communication may be based on any type of wireless communication.

As other example, the main body 100 may receive and/or transmit signals to/from the earpiece 10 by using the antenna 120.

Embodiments may include a rechargeable docking earpiece that forms part of a case of a mobile device when docked. The rechargeable docking earpiece may include a mechanism to enable an earpiece plug to collapse flat enough to allow the earpiece to be docked into very slim mobile devices. The mechanism (and/or another mechanism) may allow the earpiece plug to adapt for a natural variation in human ear sizes.

Dimensions of an earpiece may be constrained by a physical size of a human ear. The part that fits into the ear may be a synthetic plug of approximately 10 mm diameter and 10 mm deep. However, this may be too large to be concealed within a case (or body) of a slim mobile device when docked.

Embodiments may construct the expandable earpiece plug from a specially formed donut shaped bladder. The expandable earpiece plug may have a slightly conical form with a series of concentric folds such that the cone may collapse back into itself.

When the docking earpiece is docked into the mobile device, the earpiece plug may collapse neatly like a concentric bellows. A latch in the body (or housing) of the mobile device may be used to resist a tendency for the plug to expand, and may be used to retain the earpiece while being charged.

The expandable earpiece plug may be extended by inflating the earpiece plug with air, the form when extended also serving to aid secure fitting in the ear. An air pressure and thus a size of the earpiece plug may increase or decrease due to elasticity in the plug since not all ears are of a same size.

The pump (or pump device) may include a bladder housed in the body of the earpiece. The pump may be compressed by squeezing the body of the earpiece with fingers. To maintain the desired pressure, the pump may be linked to the plug via a non-return valve, and a pressure release valve may facilitate complete deflation for docking.

A mobile device having an earpiece may enable an ultra slim form factor for next generation of mobile computing.

A mobile device having an earpiece may enable mobile audio services to be used in a convenient and comfortable way.

A mobile device having an earpiece may not require the user to carry a separate headset or earpiece.

A mobile device having an earpiece may ensure that the audio interface is always re-charged/ready for use.

Embodiments of the earpiece may be relevant for all categories of mobile devices (i.e. devices that are not tied to a desk for power or network connectivity) that offer an audio output. For ease of description, such devices may simply be referred to as "mobile devices."

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus comprising:

a body;

an expandable earpiece plug coupled to the body, the earpiece plug to extend along a first axis from the body, the earpiece plug to be provided in a first state and a second state, the first state of the earpiece plug is an expanded state of the earpiece plug along the first axis, and the second state of the earpiece plug is a collapsed state of the earpiece plug along the first axis; and a first bladder in the earpiece plug to control the expandable earpiece plug to be in the expanded state and to control the expandable earpiece plug to be in the collapsed state, the expandable earpiece plug to include a plurality of concentric folds, and the earpiece plug to have a conical shape along the first axis when the earpiece plug is in the expanded state, the first bladder to expand and to push the concentric folds in a telescopic direction away from the body and into the expanded state, and the first bladder to contract and to provide the expandable earpiece plug in the collapsed state.

2. The apparatus of claim 1, further comprising a pump device to expand the first bladder such that the earpiece plug is in the first state, and to contract the first bladder such that the earpiece plug is in the second state.

3. The apparatus of claim 2, wherein the pump device includes a button and a second bladder, and the button is a pivoting button to provide gas from the second bladder to the first bladder.

4. The apparatus of claim 2, wherein the pump includes a pivoting button to release a gas from the first bladder.

5. The apparatus of claim 2, wherein the pump device includes a pressure release valve to release gas from the first bladder.

6. The apparatus of claim 2, wherein the pump device includes a second bladder and a non-release valve to prevent gas from returning to the second bladder.

7. The apparatus of claim 1, further comprising a microphone coupled to the body.

8. The apparatus of claim 1, further comprising a wireless receiver coupled to the body.

9. The apparatus of claim 1, further comprising an earpiece transducer coupled the body to provide audio signals to the earpiece plug.

10. The apparatus of claim 1, further comprising a battery coupled to the body.

11. The apparatus of claim 10, further comprising an electrical connector to charge the battery of the docking earpiece.

12. The apparatus of claim 1, further comprising:

a mobile device having a display, an antenna and a wireless communication device.

13. An earpiece comprising:

a body;

an expandable earpiece plug coupled to the body to expand away from the body along an axis; and a pump device to provide gas to the expandable earpiece plug, the pump device to expand the expandable earpiece plug along the axis in a first direction such that the expandable earpiece plug is in an expanded state, and the pump device to contract the expandable earpiece plug along the axis in a second direction such that the expandable earpiece plug is in a collapsed state, the expandable earpiece plug to include a plurality of concentric folds, and the expandable earpiece plug to have a conical shape along the first axis when the expandable earpiece plug is in the expanded state, the pump device to include a bladder to expand and to telescopically push the concentric folds away from the body along the first axis, and the bladder to contract and cause the concentric folds to be provided in the collapsed state.

14. The earpiece of claim 13, wherein the pump device further releases gas from the expandable earpiece plug causing the expandable earpiece plug to contract into a collapsed state.

15. The earpiece of claim 13, wherein the pump device includes a button and a bladder, and the button is a pivoting button to provide gas from the bladder to the expandable earpiece plug.

16. The earpiece of claim 13, wherein the pump device includes a pivoting button to release gas from the expandable earpiece plug.

17. The earpiece of claim 13, wherein the pump device includes a pressure release valve to release gas from the expandable earpiece plug.

18. The earpiece of claim 13, wherein the pump device includes a bladder and a non-release valve to prevent gas from returning to the bladder.

19. An electronic device comprising:

a first body;

a display device coupled to the first body;

an antenna to provide wireless communication; and an earpiece including:

a second body, a wireless receiver to receive a wireless signal, an expandable earpiece plug coupled to the second body to expand away from the second body along an axis, and a pump device to provide gas to the expandable earpiece plug, the pump device to expand the expandable earpiece plug along the axis in a first direction such that the expandable earpiece plug is in an expanded state, and the pump device to contract the expandable earpiece plug along the axis in a second direction such that the expandable earpiece plug is in a collapsed state, the expandable earpiece plug includes a plurality of concentric folds that expand in a telescopic direction away from the body, and the expandable earpiece plug to have a conical shape along the axis when the expandable earpiece plug is in an expanded state.

20. The electronic device of claim 19, wherein the expandable earpiece plug is in the collapsed state when the earpiece is coupled to the first body.

21. The electronic device of claim 19, wherein the pump device includes a button and a bladder, and the button is a pivoting button to provide gas from the bladder to the expandable earpiece plug.

22. The electronic device of claim 19, wherein the pump device includes a bladder and a pivoting button to release gas from the expandable earpiece plug.

23. The electronic device of claim 19, wherein the pump device includes a pressure release valve to release gas from the expandable earpiece plug.

24. The electronic device of claim 19, wherein the pump device includes a bladder and non-release valve to prevent gas from returning to the bladder.

25. The electronic device of claim 19, wherein the earpiece further includes an earpiece transducer.

26. The apparatus of claim 1, wherein each of the concentric folds has a different width.

27. The earpiece of claim 13, further comprising a bladder to expand and to push the concentric folds away from the body along the axis.

* * * * *